US009576442B1

(12) United States Patent
Baldwin et al.

(10) Patent No.: US 9,576,442 B1
(45) Date of Patent: Feb. 21, 2017

(54) ELECTRONIC SOUND LEVEL CONTROL IN AUDIBLE SIGNALING DEVICES

(71) Applicants: Christopher M. Baldwin, Avon, IN (US); Joshua K. Brown, Danville, IN (US); Mark T. Monnett, Cloverdale, IN (US)

(72) Inventors: Christopher M. Baldwin, Avon, IN (US); Joshua K. Brown, Danville, IN (US); Mark T. Monnett, Cloverdale, IN (US)

(73) Assignee: Mallory Sonalert Products, Inc., Indianapolis, IN (US)

( * ) Notice: Subject to any disclaimer, the term of this patent is extended or adjusted under 35 U.S.C. 154(b) by 30 days.

(21) Appl. No.: 14/215,469

(22) Filed: Mar. 17, 2014

Related U.S. Application Data

(63) Continuation of application No. 13/356,029, filed on Jan. 23, 2012, now Pat. No. 8,674,817, which is a continuation of application No. 12/288,846, filed on Oct. 23, 2008, now abandoned.

(51) Int. Cl.
*H04R 25/00* (2006.01)
*G08B 3/10* (2006.01)
*H04R 17/00* (2006.01)

(52) U.S. Cl.
CPC ..... *G08B 3/10* (2013.01); *H04R 17/00* (2013.01)

(58) Field of Classification Search
CPC ..... G08B 3/10; H04R 17/00
USPC ..... 381/190
See application file for complete search history.

(56) References Cited

U.S. PATENT DOCUMENTS

| | | | | |
|---|---|---|---|---|
| 3,638,223 | A | 1/1972 | Potter | |
| 3,815,129 | A * | 6/1974 | Sweany | H04R 17/00 310/316.01 |
| 3,879,702 | A * | 4/1975 | Mancone | A01M 29/18 331/163 |
| 3,922,672 | A | 11/1975 | Birt et al. | |
| 4,104,628 | A | 8/1978 | Sweany et al. | |
| 4,156,156 | A | 5/1979 | Sweany et al. | |
| 4,180,808 | A | 12/1979 | Lebet et al. | |
| 4,183,020 | A | 1/1980 | Schade | |
| 4,213,121 | A | 7/1980 | Learn et al. | |
| 4,303,908 | A * | 12/1981 | Enemark | G08B 3/10 310/316.01 |
| 4,328,485 | A * | 5/1982 | Potter | G08B 3/10 340/384.6 |
| 4,429,247 | A | 1/1984 | Feldman | |
| 4,558,305 | A | 12/1985 | Black et al. | |

(Continued)

OTHER PUBLICATIONS

MC9S08QD4 Series MCU Data Sheet, Rev. 6, © 2006-2010 Freescale Semiconductor, Inc., 198 pgs.

(Continued)

*Primary Examiner* — Naomi Small
(74) *Attorney, Agent, or Firm* — William F. Bahret

(57) ABSTRACT

In further development of U.S. Pat. No. 6,310,540 B1, an audible signal device comprising of a microprocessor or microcontroller and a sounder element, or a microprocessor or microcontroller in conjunction with electronic circuitry such as discrete components, inductors, or IC's with a sounder element where the resulting sound pressure level is controlled by changing the drive signal's frequency, size, shape, and/or duty cycle.

3 Claims, 2 Drawing Sheets

(56) References Cited

U.S. PATENT DOCUMENTS 4,616,351 A * 10/1986 Hall ..... A01M 29/18 367/139
4,626,799 A 12/1986 Matievic
4,697,932 A 10/1987 Matievic
4,700,100 A 10/1987 Congdon et al.
4,719,452 A 1/1988 Logsdon
4,904,982 A 2/1990 Lieb et al.
4,945,346 A 7/1990 Schmiemann
5,163,447 A 11/1992 Lyons
5,200,569 A * 4/1993 Moore ..... G10H 3/18 84/723
5,293,155 A 3/1994 Nicol et al.
5,386,479 A 1/1995 Hersh
5,675,311 A 10/1997 Burnett et al.
5,675,312 A 10/1997 Burnett
5,793,282 A 8/1998 Arnold et al.
5,842,288 A * 12/1998 Laseke ..... D06F 58/28 34/524
5,872,506 A 2/1999 O'Brien et al.
5,990,784 A * 11/1999 Burnett ..... G08B 3/10 340/384.1
6,130,618 A 10/2000 Burnett et al.
6,163,214 A * 12/2000 Lam ..... H03F 3/2173 330/207 A
6,310,540 B1 10/2001 Burnett et al.
6,414,604 B1 7/2002 Burnett et al.
6,512,450 B1 1/2003 Burnett et al.
6,617,967 B2 9/2003 Baldwin et al.
6,756,883 B2 6/2004 Burnett et al.
6,987,445 B1 1/2006 Burnett et al.
7,505,600 B2 3/2009 Dryer
7,584,743 B2 9/2009 Godbold
7,880,593 B2 2/2011 Baldwin et al.
7,920,069 B2 4/2011 Shain et al.
2003/0041669 A1* 3/2003 Degertekin ..... B82Y 35/00 73/651
2003/0122678 A1* 7/2003 Duncan ..... A01K 29/005 340/573.3
2004/0189445 A1* 9/2004 Tewell ..... G08B 3/10 340/384.7
2005/0012432 A1 1/2005 Murphy
2005/0219040 A1* 10/2005 Dryer ..... G08B 3/10 340/384.71
2006/0159292 A1* 7/2006 Guilbert ..... H03F 3/3061 381/120
2007/0057778 A1 3/2007 Prince, Jr. et al.
2008/0114428 A1* 5/2008 Trembly ..... A61B 18/18 607/100

OTHER PUBLICATIONS

RE46C100 Piezoelectric Horn Driver Circuit Product Specification, © 2009 Microchip Technology Inc., 4 pgs.
RE46C101 Piezoelectric Horn Driver and LED Driver Circuit Product Specification, © 2009 Microchip Technology Inc., 4 pgs.
"Signaling Solutions," Rockwell Automation Publication 855-BR001C-EN-P, © 2010 Rockwell Automation, Inc., 8 pgs.
Office Action dated Oct. 1, 2010, in U.S. Appl. No. 12/288,846 (16 pgs).
Office Action dated Jul. 21, 2011, in U.S. Appl. No. 12/288,846 (20 pgs).
Maxim Application Note 4148, "Piezoelectric Tone Generation Using the MAXQ3210," Nov. 15, 2007, © Maxim Integrated Products, 6 pgs.
MAXQ3210 Data Sheet, "Microcontroller with Internal Voltage Regulator, Piezoelectric Horn Driver, and Comparator," Rev. 1; May 2006, © 2006 Maxim Integrated Products, 28 pgs.

* cited by examiner

ELECTRONIC SOUND LEVEL CONTROL IN AUDIBLE SIGNALING DEVICES

CROSS-REFERENCE TO RELATED APPLICATIONS

This application is a continuation of patent application Ser. No. 13/356,029, filed Jan. 23, 2012, now U.S. Pat. No. 8,674,817, issued Mar. 18, 2014, which is a continuation of patent application Ser. No. 12/288,846, filed Oct. 23, 2008, which applications and patent are hereby incorporated by reference.

BACKGROUND OF THE INVENTION

This invention relates to electronic sound generating devices. More specifically, the invention relates to circuits for controlling and driving such devices. Still more specifically, the invention relates to circuits for selecting the particular sounds to be generated by such sound generating devices, and to circuits for controlling the level of sound emitted by the device.

Alarms and audible indicators have achieved widespread popularity in many applications. Of the countless examples available, just a few are sirens on emergency vehicles, in-home fire and carbon monoxide alarms, danger warnings on construction machines when the transmission is placed in reverse, factory floor danger warnings, automobile seat belt reminders, and many more. It is nearly a truism that industry prefers inexpensive but high quality devices to create such alarms and indicator sounds.

Piezoelectric transducers are sound producing electronic devices that are preferred by industry because they are by and large extremely inexpensive, reliable, durable, and versatile. This transducer has the unique property that it undergoes a reversible mechanical deformation on the application of an electrical potential across it. Conversely, it also generates an electrical potential upon mechanical deformation. These characteristics make it highly desirable for sound producing applications. When an oscillating potential is placed across the transducer, it vibrates at roughly the same frequency as the oscillations. These vibrations are transmitted to the ambient medium, such as air, to become sound waves. Piezoelectric transducers can also be coupled to a simple circuit in what is known as a feedback mode, well known in the art, in which there is an additional feedback terminal located on the element. In this mode, the crystal will oscillate at a natural, resonant frequency without the need for continuous applied driving oscillations. As long as the oscillations are in the range of audible sound, i.e., 20 to 20,000 Hertz, such oscillations can produce an alarm or an indicator.

Any periodic oscillation can be characterized by at least one amplitude and frequency. Ordinarily, the amplitude of oscillations of interest in a piezoelectric transducer application will be dictated by the voltage swing applied across the element. By the principles explained above, it is evident that there will be a greater mechanical deformation in the crystal with greater applied voltage. The effect is roughly linear within limits, those limits based in general on crystal composition and geometry. Thus, in the linear region, doubling the voltage swing doubles the mechanical deformation. Doubling the mechanical deformation increases the amplitude of vibrations transmitted into the ambient medium. Increased amplitude of vibrations in the medium causes an increased sound level, the relationship determinable by well known physical equations.

More specifically, when a piezoelectric element possesses two terminals and a driving oscillation is placed across one while the other is clamped to a common potential such as ground, the voltage swing will be at most the amplitude of the oscillations. Thus, if an oscillation of amplitude 5 volts is placed across one terminal, while the other is maintained at 0 volts, the maximum voltage swing will be 5 volts. This effectively caps the achievable decibel level of any sound to a value corresponding to the supply voltage. One could double the supply voltage to achieve double the voltage swing, but this has the disadvantage of added cost, and further is impractical when a piezoelectric audio circuit is to be placed in a unit having a standardized voltage supply such as an automobile. Alternatively, one could use a second supply disposed to provide the same oscillations but in a reversed polarity to double the effective voltage swing. But this approach possesses at least the same disadvantages.

It will be appreciated that when a piezoelectric element possesses two terminals and a driving oscillation is placed across one, and the identical driving oscillation is placed across the other but shifted 180 degrees in phase, the voltage swing will be at most two times the amplitude of the oscillations. Thus, if an oscillation of amplitude 5 volts is placed across one terminal while the other experiences the same oscillation but separated by 180 degrees of phase (half the period of the cycle), then the maximum voltage swing will be 10 volts. Higher sound pressures and louder tones are achievable with a voltage swing of 10 volts than with a voltage swing of 5 volts.

Particularly in alarm applications, what is needed is a loud sound that does not depend on the added circuit complexity of a doubled supply voltage or an additional reversed polarity supply. Loud sounds require relatively high voltages to produce relatively large amplitude vibrations in the transducer. In a special analog circuit, this might not be an obstacle. However, in a circuit containing elements that are safely and reliably operable only in a limited range of potentials, accommodations must be made to insure that those elements do not receive an electrical potential that is too high. Thus, in particular when a loud alarm sound is needed, care must be taken to separate the potentials driving the transducer from the potentials driving the more sensitive circuit elements. For example, integrated circuits often have specifications limiting the recommended power supply to 5 volts DC. If one desires to power a transducer using a supply voltage of 16 volts DC, care must be taken to regulate the power supplied to the integrated circuit.

In both alarm and indicator applications, what is needed is the ability to select different sounds to correspond to different situations. One might wish to distinguish, using discrete tones of differing frequencies, a carbon monoxide alarm from a smoke alarm while still allowing both to use the same general circuit. In an additional example, one might wish to select one set of tones in an automobile indicator system to represent unfastened seat belts, and yet another set of tones to represent a door ajar, while still allowing both to use the same general circuit. Moreover, it is desirable for such a system to utilize a circuit that inexpensively enables loud sounds to be generated without the need for a doubled or duplicated supply voltage.

It is an object of the inventions to provide a circuit for an audio transducer that enables different sounds to be generated that correspond to different operative situations.

Another object of the inventions is inexpensively to enable loud sounds to be generated by an audio circuit that overcomes the foregoing disadvantages.

Still another object of the inventions is to enable the use of voltage-sensitive components in the same circuit that contains an audio transducer that is disposed to receive large voltage swings.

Still another object of the inventions is to be able to control the sound level of an audible signaling device. One possible way is to change the shape of the mounting cavity such as by adding a physical shutter to the audible alarm that can be manually opened and closed. See, for example, Mallory Sonalert Part Number SCVC. This method is not useful to a designer or user of the audible signaling device who would want to control the sound level by electronic means. Changing the voltage of the oscillating signal to the sounder element can control the sound level of an audible signaling device. This typically requires the use of expensive integrated circuits such as digital potentiometers or voltage-controlled oscillators.

The inventions provide a method of electronic control of the sound level in audible signaling devices by changing one or more characteristics of the drive signal, such as the drive signal's frequency, size, shape, or duty cycle.

SUMMARY OF THE INVENTION

A further development of U.S. Pat. No. 6,310,540 B1, "Multiple Signal Audible Oscillator Generator," is an audible signal device comprising of a microprocessor or microcontroller and a sounder element, or a microprocessor or microcontroller in conjunction with electronic circuitry such as discrete components, inductors, or integrated circuits with a sounder element, where the resulting sound pressure level is controlled by changing the drive signal's frequency, size, shape, and/or the duty cycle. That patent is incorporated by reference here.

The microprocessor or microcontroller is programmed to provide an oscillating signal. This programming may be completely self-contained, or it may take external input such as from the user, a sensor, or feedback from the sounder element that can be used to decide how to adjust the oscillating signal.

The oscillating signal may be applied directly to the sounder element or it may go through additional electronic circuitry such as one or more discrete components (i.e. resistors, capacitors, transistors, etc.), one or more inductors, or one or more integrated circuits to condition the oscillating signal in some manner before being applied to the sounder element.

By changing one or more of the different characteristics of the oscillating signal such as the frequency, size, shape, and/or duty cycle, the resulting sound level of the audible signaling device can be changed in a controlled manner.

Optionally, the resonant frequency of the sounder element can be used by the microcontroller or microprocessor as an input to provide better control of the sound level.

In another option, external input such as from the user or from a sensor can be used by the microcontroller or microprocessor to decide which sound level to produce.

The description of the signal generator described at column 2 line 63 to column 3, line 41 of U.S. Pat. No. 6,310,540 B1 is incorporated by reference.

DESCRIPTION OF THE PREFERRED EMBODIMENTS

The description of the preferred embodiments at column 3, line 59 to column 6, line 41 in U.S. Pat. No. 6,310,540 B1 is incorporated by reference here.

Figure 1:
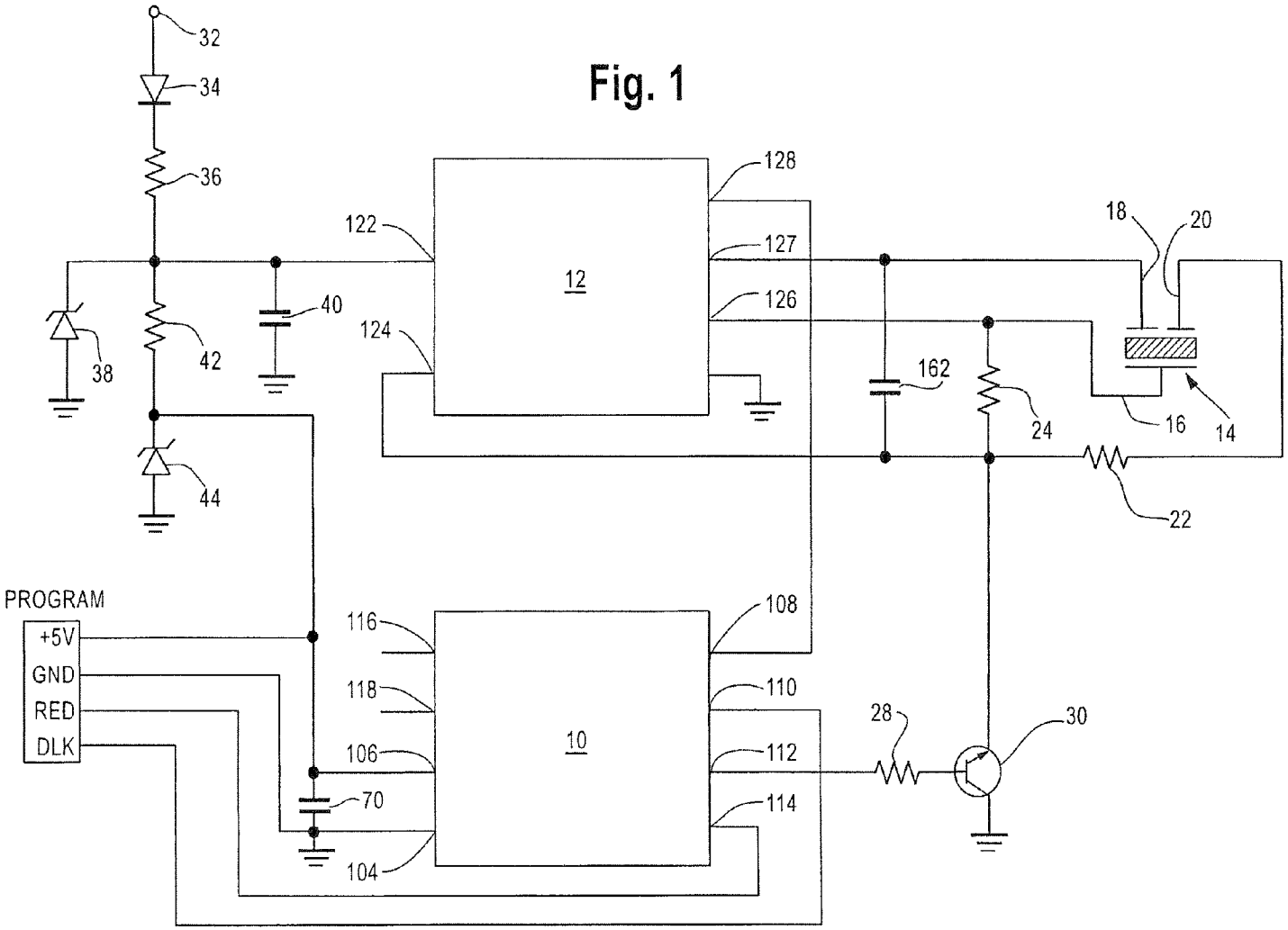
FIG. 1 depicts one embodiment using 28 volt direct current.
Figure 2:
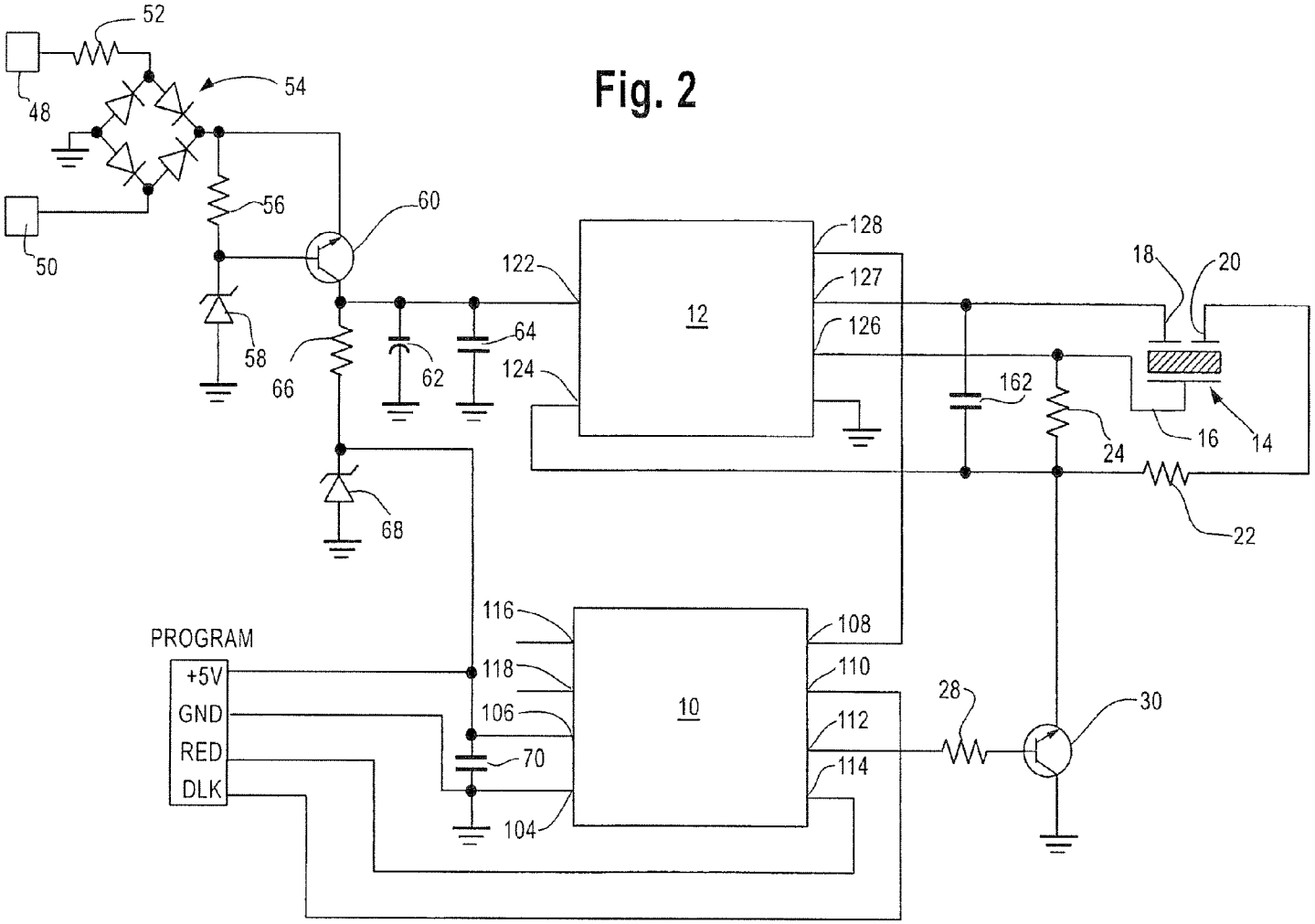
FIG. 2 depicts another embodiment using 120 volt alternating current.

In one embodiment, as shown in FIGS. 1 and 2, a microcontroller 10 is used in combination with a piezoelectric horn driver 12 to control the sequences, amplitudes, frequencies, and durations of the audio tones made by a piezoelectric transducer 14. Examples are shown in FIG. 1 and FIG. 2.

Refer to FIG. 1 first. The piezoelectric horn driver 12 is used to drive the piezoelectric transducer 14. If pin 128 of driver 12 is grounded, a low logic voltage level is applied to both NAND gates (not shown) in driver 12. This will make the outputs of both NAND gates high. The output of both inverters, pins 126 and 127 of driver 12, will be low. No voltage will be seen across leads 16 and 18 of piezoelectric transducer 14; therefore, it will be silent.

The piezoelectric horn driver 12 has two distinct modes of operation. The first mode is called feedback mode or self-oscillation mode. This mode is started by programming the microcontroller 10 to turn on the output on pin 108 of microcontroller 10. This supplies +5 VDC, or a high logic level, to pin 128 of the piezoelectric driver 12. Initially, the feedback pin, pin 124 on driver 12, will have no voltage on it, so the output of the upper NAND gate (not shown) will be high. This is not a state change, because it was high before pin 128 of driver 12 went high.

However, the output of the lower NAND gate in driver 12 will change to low due to pin 128 of driver 12 going high. This will make the output of the lower inverter, pin 126 of driver 12 high. The voltage of this high condition could be considerably higher than 5 volts and is dependent upon the voltage supply on pin 122 of driver 12. Pin 127 will still be low or approximately 0 volts. This places a potential difference across leads 16 and 18 of the transducer 14 causing it to move, thereby making a sound.

The bending of the transducer 14 induces a piezoelectric voltage between leads 16 and 20 of transducer 14. This voltage is applied through resistor 22 to pin 124 of driver 12, causing it to be interpreted as a logical high. This high on pin 124 of driver 12, combined with the high on pin 128 of 12, causes the output of the upper NAND gate to go low. This low makes the upper inverter high, placing voltage on pin 127 of driver 12. The low state of the upper NAND gate also causes the state of the lower NAND to switch from low to high. This switch on the lower inverter causes a switch of pin 126 of driver 12 from a range from −10 volts up to +22 volts to approximately 0 volts.

The leads 16 and 18 of piezoelectric transducer 14 now have a voltage of opposite polarity across them. This causes the transducer 14 to deflect in the opposite direction. As a result, the induced voltage between leads 16 and 20 of transducer 14 will drop until a logical low is read at pin 124 of driver 12. This is the same as the start state of the mode with pin 128 of driver 12 high and pin 124 of driver 12 low. Thus, as long as pin 128 of driver 12 is held high and the feedback path through resistor 22 is not dampened, pins 126 and 127 of driver 12 will alternate opposite states at the resonant frequency of the circuit.

This resonant frequency is primarily determined by the physical properties of the piezoelectric transducer 14. These properties include its: capacitance, diameter, thickness, stiffness, and composition of the disc and crystal. The mounting of the piezoelectric transducer and the geometry of the surrounding sound chamber are also important. See U.S. Pat. No. 6,512,450, "Extra Loud Frequency Acoustical Alarm Assembly," for an example of mounting and geometry.

The amplitude and resonant frequency is also influenced by the values of the components that make up the feedback network. These components are: piezoelectric transducer 14, resistors 22 and 24, capacitor 62, and the internal circuitry of piezoelectric driver 12.

So in feedback mode, the circuit oscillates at resonance whenever pin 128 of microcontroller 10 is set high and is silent whenever pin 128 of microcontroller 10 is cleared or made low. Pin 126 of microcontroller 10 must stay low while in feedback mode.

Another mode of operation for the piezoelectric driver 12 is called direct-drive mode. The microcontroller 10 is programmed to turn on the output on pin 108 of microcontroller 10. Current passes through resistor 28 to forward bias the base-emitter junction of transistor 30. The feedback voltage is effectively shorted out by transistor 30 and pin 124 of piezoelectric driver 12 is tied low.

Direct-drive mode is also started by programming the microcontroller 10 to turn the output on pin 108 of microcontroller 10 high. This makes pin 128 of the piezoelectric driver 12 high. Since, the feedback pin 124 is tied low, the output of the upper NAND gate will be high. The output of the upper inverter at pin 127 of piezoelectric driver 12 will be low.

When the output of the upper NAND is combined with the high on pin 128 of driver 12, the output of the lower NAND gate will change to low. This will make the output of the lower inverter, pin 126 of driver 12 high. This places a voltage across leads 16 and 18 of the transducer 14. Since the feedback pin 124 is tied low, pin 127 of driver 12 will always be low and pin 126 of driver 12 will be high only when pin 128 of driver 12 is high. Therefore, the frequency of the piezoelectric transducer will be directly driven by the frequency generated by pin 108 of microcontroller 10, when pin 106 of microcontroller 10 is set high.

An example of a 28 volt direct current model is shown in FIG. 1. A direct current voltage in the range of 6 to 28 volts DC is applied between $V_{DD}$ 32 and ground. Diode 34 protects the circuit from a reversed polarity voltage. Resistor 36 is used to drop the difference between VDD 32 and the +16 VDC supply as regulated by zener diode 38. Capacitor 40 is used to minimize fluctuations in the +16 VDC supply to pin 2 of piezoelectric horn driver 12.

Other DC power supply voltage ranges are made by properly choosing resistor 36. The value of resistor 36 must be selected low enough to pass the maximum amount of current required by the circuit during operation. It must also have a high enough resistance to kept the current through zener diode 38 low enough to allow it to regulate the voltage during minimum current usage by the circuit. Resistor 36 could be a single resistor or a series or parallel network of resistors to have the proper resistance and power dissipation capacity. In the preferred embodiment, 660 ohms was used.

Resistor 42 is used to drop the difference between the +16 VDC supply and the +5 VDC supply as regulated by zener diode 44. Capacitor 46 is used to stabilize the +5 Volt supply to pin 3 of microcontroller 10.

An example of a 120 volt alternating current model is shown in FIG. 2. An alternating current voltage in the range of 24 to 120 volts AC is applied between terminals 48 and 50. Resistor 52 limits the surge current for the circuit. Full wave bridge rectifier 54 comprised of four diodes, converts the AC voltage to a pulsating DC voltage. Resistor 56 is used to limit the current required by zener diode 58 necessary to regulate the +16 VDC supply to the base of transistor 60. Since a forward-biased P-N junction will drop approximately 0.7 volts, the voltage at the emitter of transistor 60 will stay around +15.3 volts with respect to ground. Capacitor 62 is used to stabilize the +15.3 VDC supply by storing energy until it needed by the circuit. Capacitor 64 is used to minimize fluctuations in the +15.3 VDC supply to pin 2 of piezoelectric horn driver 12.

Resistor 66 is used to drop the difference between the +16 VDC supply and the +5 VDC supply as regulated by zener diode 68. Capacitor 70 is used to stabilize the +5 Volt supply to pin 3 of microcontroller 10.

Pins 110, 114, 116 and 118 of microcontroller 10 are optional inputs for creating multiple sounds as described in U.S. Pat. No. 6,310,540 B1, "Multiple Signal Audible Oscillator Generator." See, for example, column 2, lines 43-50, column 3, lines 4-12, and column 5, lines 5-25 of the patent. Programming is within the knowledge of one of ordinary skill in the art.

In the preferred embodiment, microcontroller 10 is a Freescale MC9S08QD2 microcontroller, and piezoelectric driver 12 is an R & E RE46C100 piezoelectric horn driver circuit. Other equivalent products known to one of skill in the art may also be used.

It will be appreciated that those skilled in the art may now make many uses and modifications of the specific embodiments described without departing from the inventive concepts.

We claim:

1. An audible signal device, comprising:

a piezoelectric transducer having two primary terminals and a feedback terminal;

a driver circuit having outputs connected to the primary terminals of the piezoelectric transducer and an input connected to the feedback terminal; and a programmable controller configured to electronically select between a feedback mode and a direct-drive mode of transducer operation, the controller generating a driver enable signal and a feedback enable signal, wherein feedback mode is selected by the controller setting the feedback enable signal to a first state, direct-drive mode is selected by the controller setting the feedback enable signal to a second state, and, in direct-drive mode, the driver enable signal is used to drive the piezoelectric transducer, with the driver enable signal oscillating at a frequency other than the natural resonant frequency of the piezoelectric transducer.

2. An audible signal device, comprising:

a piezoelectric transducer having two primary terminals and a feedback terminal;

a driver circuit having outputs connected to the primary terminals of the piezoelectric transducer and an input connected to the feedback terminal; and a programmable controller configured to electronically select between a feedback mode and a direct-drive mode of transducer operation, the controller generating a driver enable signal and a feedback enable signal, wherein feedback mode is selected by the controller setting the feedback enable signal to a first state, wherein direct-drive mode is selected by the controller setting the feedback enable signal to a second state, wherein the driver enable signal has first and second steady states respectively enabling and disabling said driver circuit, wherein, in feedback mode, the driver enable signal is in its first steady state enabling said driver circuit, and wherein, in direct-drive mode, the driver enable signal is used to drive the piezoelectric transducer, with the driver enable signal oscillating at a frequency other than the natural resonant frequency of the piezoelectric transducer.

3. The audible signal device of claim 1, wherein said transducer is a three-terminal piezoelectric transducer.

* * * * *